United States Patent [19]

Kondo et al.

[11] 4,202,295

[45] May 13, 1980

[54] FUEL SUPPLY CONTROL SYSTEM FOR INTERNAL COMBUSTION ENGINES

[75] Inventors: Toshio Kondo, Anjo; Susumu Harada, Oobu; Nobuyuki Ito, Hekinan; Nobuyuki Kobayashi, Toyota, all of Japan

[73] Assignees: Nippondenso Co., Ltd., Kariya; Toyota Jidosha Kogyo Kabushiki Kaisha, Toyota, both of Japan

[21] Appl. No.: 794,648

[22] Filed: May 6, 1977

[30] Foreign Application Priority Data

Sep. 23, 1976 [JP] Japan ..... 51-114213

[51] Int. Cl.[2] ..... F02B 3/00

[52] U.S. Cl. ..... 123/32 EH; 123/32 EA

[58] Field of Search ..... 123/32 EA, 32 EH, 119 EC, 123/32 EL

[56] References Cited

U.S. PATENT DOCUMENTS

| | | | |
|---|---|---|---|
| 2,845,910 | 8/1958 | Pribble | 123/32 EA |
| 3,272,187 | 9/1966 | Westbrook et al. | 123/32 EA |
| 3,661,126 | 5/1972 | Baxendale | 123/32 EH |
| 3,673,989 | 7/1972 | Aono et al. | 123/32 EH |
| 3,749,070 | 7/1973 | Oishi et al. | 123/32 EA X |
| 3,935,851 | 2/1976 | Wright et al. | 123/32 EA X |
| 3,983,851 | 10/1976 | Hoshi | 123/32 EA |
| 4,010,717 | 3/1977 | Taplin | 123/32 EH |
| 4,048,964 | 9/1977 | Kissel | 123/32 EA X |

*Primary Examiner*—Tony Argenbright

*Attorney, Agent, or Firm*—Cushman, Darby & Cushman

[57] ABSTRACT

A fuel supply control system for internal combustion engines properly controls the additional fuel supply at high speed operation and full load operation of the engine without causing overheating of the exhaust gas purifying device of the engine. The fuel supply control system includes a throttle switch for generating a load detection signal when the throttle valve is at its substantially full open position indicative of the heavy load condition of the engine and includes a high speed detecting device for generating a high speed detection signal when the amount of air sucked into the engine or when the intermittent signals from an ignition device exceeds a predetermined amount. In response to at least one of the detection signals, the additional fuel is supplied to the engine.

1 Claim, 5 Drawing Figures

FUEL SUPPLY CONTROL SYSTEM FOR INTERNAL COMBUSTION ENGINES

BACKGROUND OF THE INVENTION

1. Field of the Invention

The present invention relates to a fuel supply control system for an internal combustion engine of the type equipped with a device for purifying exhaust gases such as a catalyst or reactor, which is effective in preventing overheating of the exhaust purifying device during high speed and high load operations of the engine.

2. Description of the Prior Art.

In a known type of electronically controlled fuel injection system in which the amount of air drawn into an engine and the rotational speed of the engine are electrically detected to control the amount of fuel supplied to the engine, a throttle switch is usually provided to detect the opening of the throttle valve, whereby when the throttle opening exceeds a predetermined opening (hereinafter referred to as a wide open enrichment opening), in response to the output of the throttle switch the amount of fuel supplied to the engine is increased to enrich the mixture drawn into the engine. This is done with the intention of increasing the maximum power output of the engine during periods of high load operation. However, where there is no secondary air supply, the temperature of an exhaust purifying device, e.g., a catalyst or reactor for purifying the exhaust gases from the engine is at its maximum when the air-fuel ratio of the mixture is at around the stoichiometric ratio, and when the mixture is rich, the temperature decreases as the mixture is enriched but when the mixture is leaned, the temperature does not decrease so much as the mixture is enriched. Moreover, with known exhaust purifying devices of the type which are not supplied with secondary air, the temperature of such exhaust purifying device generally tends to become higher than the permissible temperature before the throttle valve is opened to the wide open enrichment opening during high speed and high load operations of the engine. To overcome this difficulty, a method has been proposed in which the wide open enrichment opening for the throttle switch is preset small, thus increasing the engine operating ranges where the mixture is enriched and thereby preventing overheating of such exhaust purifying device during periods of high speed and load operations where the temperature of the device tends to increase. With this method, however, any excessively small setting of the wide open enrichment opening tends to cause excessive exhaust gas emissions during normal running conditions, and there is thus a lower limit to the wide open enrichment opening which in turn makes it impossible to effectively prevent overheating of the exhaust purifying device.

SUMMARY OF THE INVENTION

It is the object of this invention to provide an improved fuel supply control system for internal combustion engines which overcomes the foregoing deficiencies of the prior art.

In accordance with the invention, there is thus provided an improved fuel supply control system wherein the amount of fuel supplied to an engine is increased in accordance with at least one of a detection signal produced when the throttle opening of the engine reaches a predetermined enrichment opening and a detection signal produced when the engine comes into high speed operation, whereby the high-speed operation and high-load operation of the engine are separately detected and common enrichment means is operated to properly increase the fuel and thereby prevent overheating of the exhaust purifying device mounted in the exhaust manifold of the engine without any deterioration in the operating efficiency of the engine.

DESCRIPTION OF THE PREFERRED EMBODIMENTS

The present invention will now be described in greater detail with reference to the illustrated embodiments.

Figure 1:
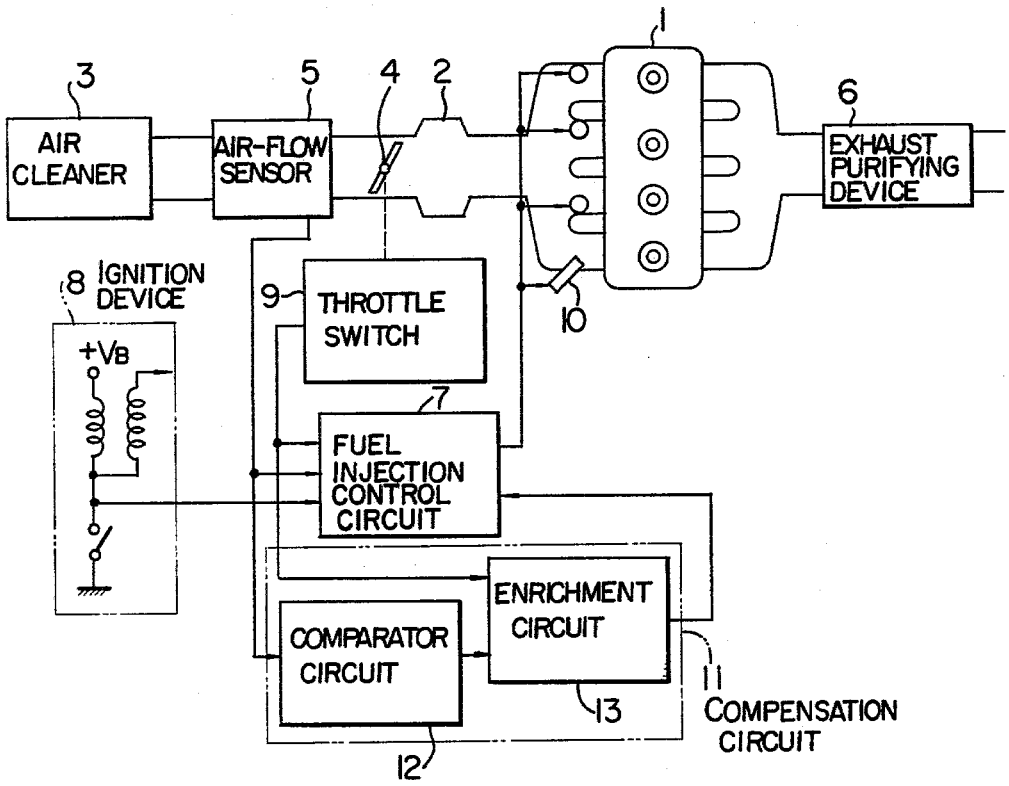
FIG. 1 is a schematic block diagram showing the general construction of a first embodiment of a fuel supply control system for internal combustion engine according to the invention.
Figure 2:
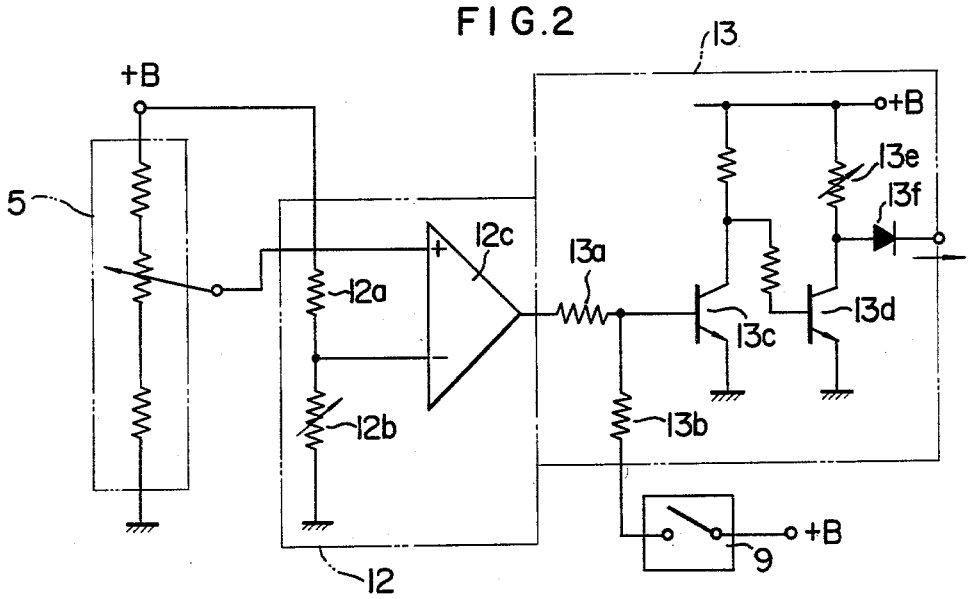
FIG. 2 is a wiring diagram showing a detailed construction of the principal parts of the embodiments shown in FIG. 1.

In the drawings, FIG. 1 is a schematic block diagram showing a first embodiment of the system of this invention, and FIG. 2 is a wiring diagram showing a detailed construction of the principal parts of the first embodiment. In FIG. 1, numeral 1 designates a four cylinder internal combustion engine, 2 an intake pipe having an air cleaner 3 for filtering the air entering thereinto, a throttle valve 4 and an air-flow sensor 5 for measuring the amount of air drawn into the engine 1. An exhaust purifying device 6 including for example a reactor or catalyst, is mounted in the exhaust manifold of the engine 1. Numeral 7 designates an electronic fuel injection control circuit whereby various operating parameters of the engine 1 which are represented by the intermittent signal from the primary winding of the ignition coil in an ignition device 8, the signal from the air-flow sensor 5, etc., are detected electrically to determine the duration of the opening of fuel injection valves 10 mounted in the respective engine cylinders and thereby control the amount of fuel supplied to the engine 1, and this injection system is of a known type. Numeral 9 designates a throttle switch operatively associated with the throttle valve 4 to generate a detection signal when the throttle valve 4 is opened to a predetermined enrichment opening near the full opening. Numeral 11 designates a compensation circuit whereby during high speed and load operation of the engine 1 the supply of additional fuel is properly controlled to prevent overheating of the exhaust purifying device 6, 12 a comparator circuit which generates a detection signal when the air-flow signal from the air-flow sensor 5 reaches a predetermined value, the comparator circuit 12 constituting high speed operation detecting means for detecting that the engine 1 has come into a high speed operation. Numeral 13 designates an enrichment circuit which performs the OR operation on the detection signal from the throttle switch 9 and the detection signal from the comparator circuit 12 to generate an enrichment signal in accordance with at least one of these detection signals, and this enrichment signal is applied to the fuel injection control circuit 7 constituting enrichment means to increase the amount of fuel supplied.

Referring now to FIG. 2 showing a detailed construction of the compensation circuit 11, the comparator circuit 12 comprises adjustable voltage dividing resistors 12*a* and 12*b* for determining a preset value, and a comparator 12*c* for comparing the air-flow signal from the air-flow sensor 5 with the preset value, whereby a high level detection signal is generated when the engine comes into a high speed operation and the air-flow signal exceeds the preset value. The enrichment circuit 13 which receives the detection signals from the comparator circuit 12 and the throttle switch 9, comprises input resistors 13*a* and 13*b* and transistors 13*c* and 13*d* forming an OR logic, and a variable resistor 13*e* and a diode 13*f* for delivering an enrichment signal, whereby when at least one of the said detection signals is generated, the transistor 13*c* is turned on and the following transistor 13*d* is turned off, thus generating a high level enrichment signal by way of the variable resistor 13*e* and the diode 13*f*.

With the construction described above, the operation of the first embodiment is as follows. During normal operation of the engine, the air-flow signal from the air-flow sensor 5, the intermittent signal produced from the ignition device 8 and synchronized with the engine rotational speed, and the signal from the throttle switch 9 are applied to the fuel injection control circuit 7, whereby the amount of fuel required is computed in accordance with the operating conditions of the engine 1 and the resulting injection pulse is applied in synchronism with the rotation of the engine 1 to the fuel injection valve 10 mounted in each cylinder, thereby injecting fuel into the engine. In this condition, the amount of exhaust gases from the engine 1 is not large and the exhaust gas temperature is not so high, thus allowing the exhaust purifying device 6 to perform its normal purifying function and thereby preventing the overheating thereof.

When the throttle valve 4 is opened nearly to the full open position greater than the predetermined enrichment opening while the vehicle is going uphill or accelerating, the throttle switch 9 is closed. When this occurs, a high level detection signal is applied to the resistor 13*b* of the enrichment circuit 13, so that the transistor 13*c* is turned on and the following transistor 13*d* is turned off, thereby producing an enrichment signal through the variable resistor 13*e* and the diode 13*f*. This enrichment signal is applied to the fuel injection control circuit 7, and the duration of the injection pulse is increased to increase the amount of fuel supplied to the engine 1. This enriches the mixture and the exhaust purifying device 6 is prevented from being overheated by an increased amount of high temperature exhaust gases produced upon coming into the high load operation.

On the other hand, when the engine 1 comes into a high speed operation under the intermediate load condition with the opening of the throttle valve 4 being smaller than the predetermined enrichment opening, the voltage of the air-flow signal from the air-flow sensor 5 rises and becomes higher than the preset value of the comparator 12*c* which was preset by the voltage dividing resistors 12*a* and 12*b*, and the comparator 12*c* generates at its output a high level detection signal. Consequently, the high level signal is applied to the input resistor 13*a* of the enrichment circuit 13, so that the preceding transistor 13*c* is turned on and the following transistor 13*d* is turned off, thus producing an enrichment signal through the variable resistor 13*e* and the diode 13*f* and causing the fuel injection control circuit 7 to increases the amount of fuel supplied. This enriches the mixture drawn into the engine, thus preventing overheating of the exhaust purifying device 6 due to an increase in the amount of high temperature exhaust gases.

Thus, by virtue of the fact that the high load operation and high speed operation of the engine 1 are separately detected and the common enrichment means is operated to increase the amount of fuel supplied, overheating of the exhaust purifying device 6 can be prevented without deteriorating the operating efficiency of the engine.

Figure 3:
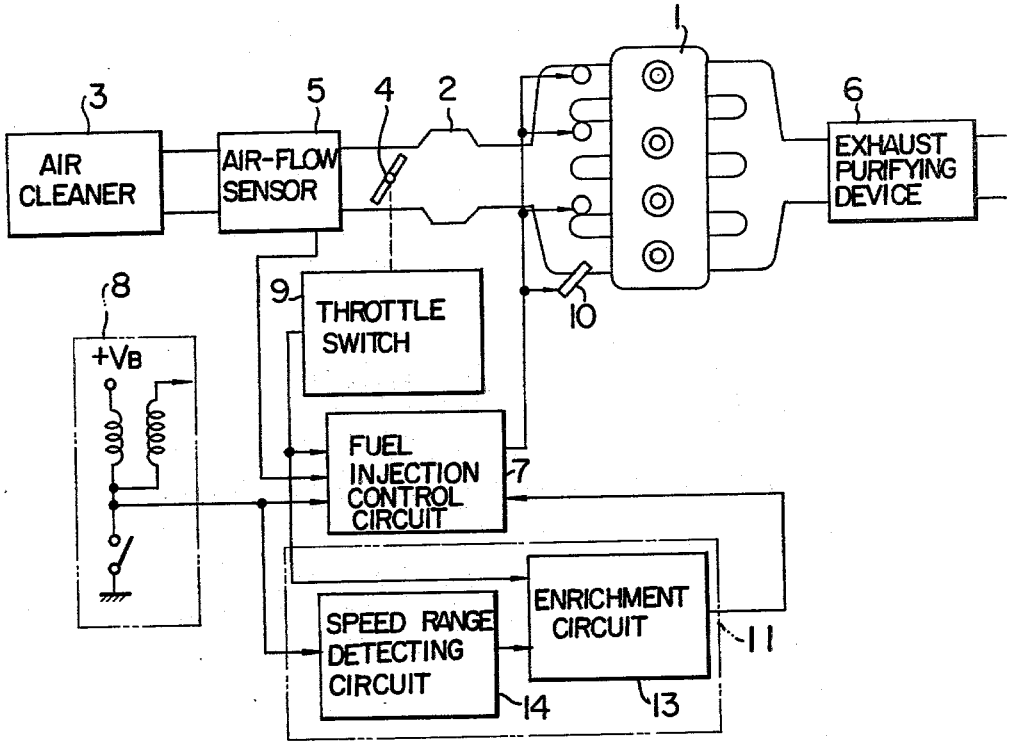
FIG. 3 is a schematic block diagram showing the general construction of a second embodiment of the system according to the invention.
Figure 4:
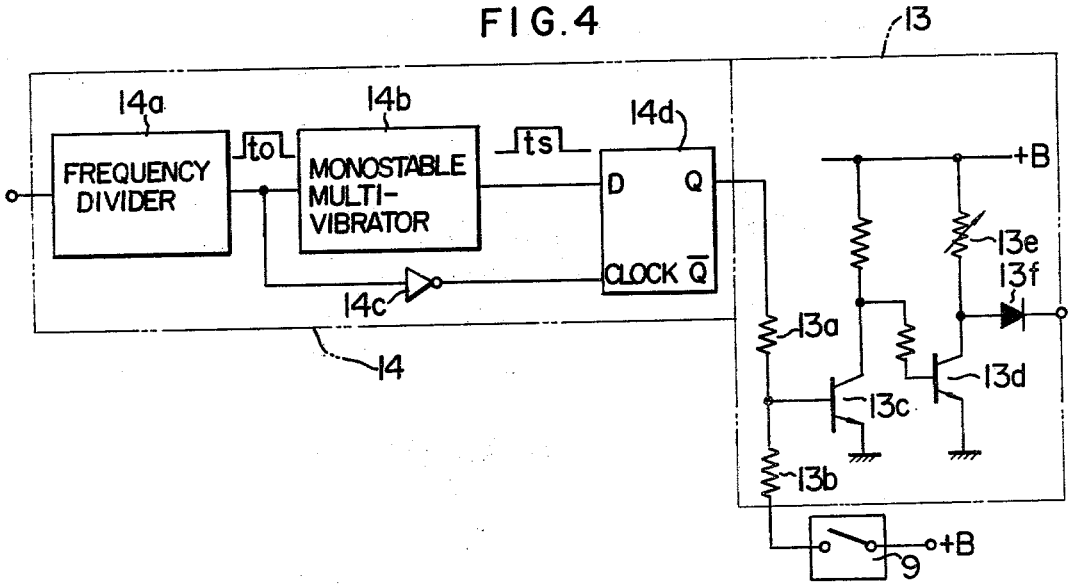
FIG. 4 is a wiring diagram showing a detailed construction of the principal parts of the embodiment shown in FIG. 3.

Referring now to FIG. 3, there is illustrated a schematic block diagram showing a second embodiment of the invention, and FIG. 4 is a wiring diagram showing a detailed construction of the principal parts of the second embodiment. The second embodiment shown in FIGS. 3 and 4 is identical with the first embodiment excepting means for detecting the high speed operation of the engine. More specifically, its high speed operation detecting means comprises a speed range detecting circuit 14 adapted to generate a detection signal when the rotational speed of the engine 1 reaches a predetermined value. In FIG. 4 showing a detailed construction of the compensation circuit 11 including the speed range detecting circuit 14 and the enrichment circuit 13, the speed range detecting circuit 14 comprises a frequency divider circuit 14*a* for dividing the frequency of the intermittent signal produced from the ignition device 8 and synchronized with the engine rotational speed, a monostable multivibrator 14*b* adapted to be triggered in response to the leading edge of the divided signal $t_o$ from the frequency divider circuit 14*a* to generate a timing pulse $t_s$ having a constant time width, an inverter 14*c* for inverting the divided signal, and a D-type flip-flop 14*d* for receiving the timing pulse $t_s$ at its data input and the inverted signal from the inverter 14*c* at its clock input. With the construction described above, during the intermediate speed operation where the engine rotational speed is lower than a predetermined value, the time width of a divided signal $t_o$ from the frequency divider circuit 14*a* is longer than that of the timing pulse $t_s$ produced from the monostable multivibrator 14*b*, and the data input of the D-type flip-flop 14*d* goes to the low level before the clock input of the flip-flop 14*d* is changed from the low level to the high level. Thus, the D-type flip-flop 14*d* stores this low level maintaining its Q output at the low level, and consequently no detection signal indicative of high speed operation is generated and applied to the enrichment circuit 13. When the engine rotational speed increases and reaches the predetermined value, the time width of the divided signal $t_o$ from the frequency divider circuit 14*a* becomes shorter than that of the timing pulse $t_s$ from the monostable multivibrator 14*b*, and the data input of the D-type flip-flop 14*d* is kept at the high level when the clock input of the flip-flop 14*d* is changed from the low level to the high level. Consequently, the D-type flip-flop 14*d* stores the high level data input so that its Q output goes to the high level and a detection signal indicative of high level and a detection signal indicative of high speed operation is generated. When this occurs, the transistor 13*c* of the enrichment circuit 13 is turned on and the following transistor 13*d* is turned off, with the result that an enrichment signal is generated through the variable resistor 13*e* and the diode 13*f*, and additional fuel is supplied to the engine 1, thus preventing overheating of the exhaust purifying device 6 during high speed operation in the similar manner as the first embodiment. Also during high load operation, overheating of the exhaust purifying device 6 is prevented in response to a detection signal from the throttle switch 9.

Figure 5:
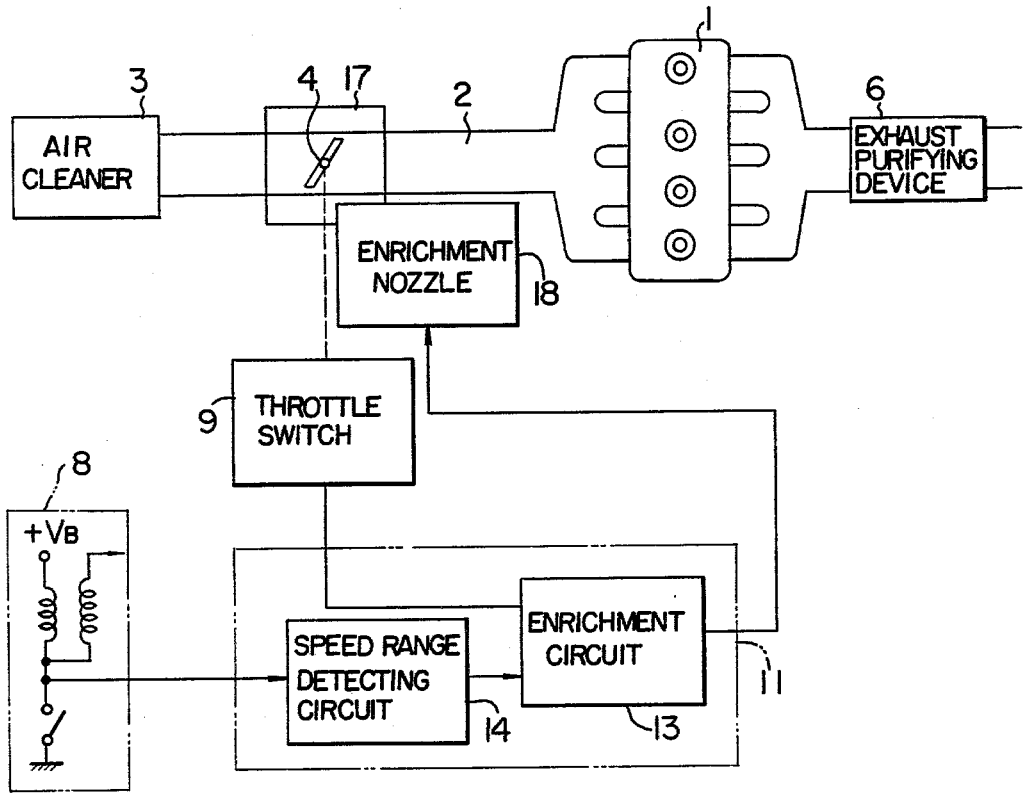
FIG. 5 is a schematic block diagram showing a third embodiment of the system according to the invention.

Referring now to FIG. 5 illustrating the general construction of a third embodiment of the invention, the similar enrichment function as the second embodiment is incorporated in the engine 1 having a carburetor 17. The carburetor 17 is provided with an enrichment nozzle 18 for supplying additional fuel during high load and speed operations. The compensation circuit 11 for applying an enrichment signal to the enrichment nozzle 18 is identical in construction with the counterpart of the second embodiment.

With the construction described above, when the operating condition of the engine 1 comes into a high speed operation, the speed range detecting circuit 14 generates a detection signal, and the enrichment circuit 13 applies an enrichment signal to the enrichment nozzle 18, thus supplying additional fuel into the carburetor 17 and thereby preventing overheating of the exhaust purifying device 6 due to increase in the amount of high temperature exhaust gases. Also, when the operating condition of the engine 1 comes into a high load operation, the throttle switch 9 is closed generating a detection signal, and the enrichment circuit 13 generates an enrichment signal, thus supplying additional fuel and thereby similarly preventing overheating of the exhaust purifying device 6.

It is possible to arrange so that in place of the speed range detecting circuit 14 of the compensation circuit 11 in the second and third embodiments, the intermittent signal from the ignition device 8 is converted by a D-A converter circuit into an analog signal which in turn is compared with a preset value by an analog comparator to generate a detection signal indicative of high speed operation.

It will thus be seen from the foregoing description that the present invention has a great effect that since the enrichment circuit generates an enrichment signal upon receipt of at least one of a detection signal generated from the throttle sensor upon the throttle opening of the engine reaching a predetermined enrichment opening and a detection signal generated from the high speed operation detecting means upon the engine operating condition coming into a high speed operation and the enrichment means is operated by this enrichment signal to increase the amount of fuel supplied to the engine, the high speed operation and high load operation of the engine can be detected separately and the fuel quantity can be suitably increased to thereby prevent overheating of the exhaust purifying device mounted in the exhaust manifold of the engine without deteriorating the operating efficiency of the engine.

We claim:

1. A fuel supply control system for an internal combustion engine, said engine having associated therewith an exhaust gas purifying device, said fuel supply control system comprising:

means for supplying fuel to said engine in accordance with operating conditions of said engine, said fuel supplying means including;

an air-flow sensor, positioned upstream of said throttle valve, for generating an air-flow signal which increases as the amount of air sucked into said engine increases;

an ignition device for generating an ignition signal at an interval which decreases as the rotational speed of said engine increases;

a fuel injector, positioned downstream of said throttle valve, for injecting fuel into said engine during the opening thereof, and;

an electronic injection controller, connected to said fuel injector, for controlling the opening period of said injector in response to said air-flow signal and said ignition signal;

means for generating a load detection signal when said engine is under the heavy load condition, said load signal generating means including;

a throttle switch, coupled to said throttle valve, for generating said load detection signal when said throttle valve is fully opened;

means for generating a speed detection signal when the rotational speed of said engine is higher than a predetermined speed, said speed detection signal generating means including;

a divider, connected to said ignition device, for generating a first pulse having a time width which decreases as said rotational speed increases;

a monostable multivibrator, connected to said divider, for generating a second pulse having a constant time width which corresponds to said predetermined speed in synchronization with said first pulse signal, and;

a comparator, connected to receive said first pulse and said second pulse, for comparing said time width of said first pulse with said constant time width of said second pulse;

means for generating an enrichment signal when at least one of said load detection signal and said speed detection signals is generated; and means for supplying additional fuel into said engine when said enrichment signal is generated, whereby overheating of said purifying device is prevented.

* * * * *